US011583898B2

(12) United States Patent
Behling et al.

(10) Patent No.: US 11,583,898 B2
(45) Date of Patent: Feb. 21, 2023

(54) METHOD AND DEVICE FOR PRODUCING AND MAINTAINING AN ASSIGNMENT OF OBJECT DATA AND THE POSITION OF AN OBJECT

(71) Applicants: BEUMER Group GmbH & Co. KG, Beckum (DE); Fraunhofer-Gesellschaft zur Förderung der angewandten Forschung e.V., Munich (DE)

(72) Inventors: Jan Behling, Dortmund (DE); Jan Josef Jesper, Delbrück (DE)

(73) Assignee: BEUMER Group GmbH & Co. KG, Beckum (DE)

( * ) Notice: Subject to any disclaimer, the term of this patent is extended or adjusted under 35 U.S.C. 154(b) by 0 days.

(21) Appl. No.: 16/925,566

(22) Filed: Jul. 10, 2020

(65) Prior Publication Data

US 2021/0008599 A1 Jan. 14, 2021

(30) Foreign Application Priority Data

Jul. 12, 2019 (EP) ..... 19185901

(51) Int. Cl.
*B07C 5/36* (2006.01)
*B07C 5/10* (2006.01)
*B07C 5/12* (2006.01)

(52) U.S. Cl.
CPC ..... *B07C 5/10* (2013.01); *B07C 5/12* (2013.01); *B07C 5/362* (2013.01)

(58) Field of Classification Search
CPC .... B07C 5/10; B07C 5/12; B07C 5/36; B07C 5/361; B07C 5/362; B07C 5/38
See application file for complete search history.

(56) References Cited

U.S. PATENT DOCUMENTS 6,567,116 B1 * 5/2003 Aman ..... G01S 17/66 348/169
7,377,429 B2 * 5/2008 Anderson ..... B07C 3/20 235/375

(Continued)

FOREIGN PATENT DOCUMENTS

CN 108701239 10/2018

OTHER PUBLICATIONS

European Search Report for European Application No. 19185901.6, dated Jan. 16, 2020, 6 pages.

*Primary Examiner* — Joseph C Rodriguez
(74) *Attorney, Agent, or Firm* — Ganz Pollard, LLC

(57) ABSTRACT

Method for producing and maintaining an assignment of object data of an object to a changing physical position of the object in a sorting device, with the steps: feeding in an object at an entry point to the sorting device, capturing and storing identity data as part of the object data of the object; on the basis of sorting data, determining a transfer point assigned to the object; transporting the item as far as the specified transfer point; discharging the object at the specified transfer point; capturing optical object data of each object ejected at the transfer point once the object has reached a predetermined position on the sorting device, at the transfer point or along a delivery path extending from the transfer point to a removal point, and storing the optical object data as a further part of the object data of the object; transporting the object along the delivery path; and during that transportation, tracking the discharged object on the basis of the optical object data by means of tracking, and storing a current position of the object as a further part of the object data of the object, as well as a device for executing the process.

17 Claims, 2 Drawing Sheets

(56) References Cited

U.S. PATENT DOCUMENTS

| | | | | |
|---|---|---|---|---|
| 7,816,617 | B2 * | 10/2010 | Bennett | B07C 3/02 209/584 |
| 9,192,965 | B2 * | 11/2015 | Serjeantson | B07C 5/3422 |
| 9,676,003 | B2 * | 6/2017 | Kara | B07C 1/00 |
| 9,731,328 | B2 * | 8/2017 | DeFillipi | B07C 5/342 |
| 10,099,259 | B2 * | 10/2018 | Anup | B07C 5/342 |
| 10,207,296 | B2 * | 2/2019 | Garcia | B07C 5/34 |
| 10,646,898 | B2 * | 5/2020 | Hillerich, Jr. | B25J 9/0093 |
| 10,766,711 | B2 * | 9/2020 | Lundahl | B65G 43/10 |
| 2008/0290005 | A1 * | 11/2008 | Bennett | B07C 3/02 209/584 |
| 2009/0114575 | A1 * | 5/2009 | Carpenter | B07C 7/005 209/584 |
| 2009/0145967 | A1 * | 6/2009 | Carpenter | G07B 17/00661 235/385 |
| 2010/0155194 | A1 * | 6/2010 | Schafer | B65G 47/31 198/357 |
| 2013/0238124 | A1 * | 9/2013 | Suzuki | B25J 9/1697 700/250 |
| 2014/0305850 | A1 | 10/2014 | Serjeantson et al. | |
| 2016/0199884 | A1 * | 7/2016 | Lykkegaard | B25J 9/0093 700/223 |
| 2016/0228920 | A1 * | 8/2016 | Doublet | B07C 5/02 |
| 2019/0202642 | A1 * | 7/2019 | Schroader | B65G 43/10 |

* cited by examiner

METHOD AND DEVICE FOR PRODUCING AND MAINTAINING AN ASSIGNMENT OF OBJECT DATA AND THE POSITION OF AN OBJECT

BACKGROUND

The invention relates to a method and a device for producing and maintaining an assignment of object data of an object to a changing physical position of the object in a sorting device which comprises at least one entry point for feeding objects to the sorting device and a plurality of transfer points at which selected objects can be discharged from the sorting device.

In order to identify an object that has been discharged from a sorting facility, e.g. a sorting conveyor, one can use the sorting data of the objects on the sorting conveyor that are available via the control unit of the sorting conveyor, wherein for example image matching or a comparison of other identification features such as barcodes, etc. can then be carried out. Such assignment is complex. Furthermore, when an object is discharged, the unambiguous assignment between object and position is usually lost, because objects overtake one another or are pushed over one another.

The task of the present invention is to not lose, at any point in time, the assignment between a discharged object and its position during a course of movement of the object following on from the discharge process, and furthermore, in the event that the assignment is lost once, to restore it without substantial effort.

SUMMARY

To solve the above problem, the invention proposes a method for producing and maintaining an assignment of the object data of an object to a changing physical position of the object in a sorting device which comprises at least one entry point for feeding objects to the sorting device and a plurality of transfer points at which selected objects can be discharged from the sorting device, with the steps:

- feeding in an object, of which at least one identity feature can be stored as part of the object data of the object, at an entry point of the sorting device, capturing of identity data before, during or after such feeding in, and storage of the identity data as part of object data of the object,
- on the basis of sorting data from which a sorting target for the object can be derived for each object, determining a transfer point that is assigned to the object,
- transporting the object as far as the specified transfer point,
- discharging the object at the specified transfer point,
- capturing optical object data of each object discharged at the transfer point once the object has reached a predetermined position on the sorting device, at the transfer point or along a delivery path extending from the transfer point to a removal point, and storing the optical object data as a further part of the object data of the object,
- transporting the object along the delivery path,
- during that transportation, following the discharged object on the basis of the optical object data by means of tracking, wherein the tracking comprises repeated determination of the position of the object along the delivery path, successively at chronological intervals, until the object is removed, and storing a current position of the object as a further part of the object data of the object.

In the case of such an identification of an object at a specific transfer point, e.g. of a particular discharge device of a sorting conveyor, advantageous use is made of the fact that an object to be sorted is already identified when it is fed to the sorting conveyor or when it is on the sorting conveyor itself, so that the object can be discharged at a particular transfer point that is assigned to it.

The object data of a particular object preferably comprise at least identity data for the object which can be stored in a higher-level control unit of the sorting device. The identity data may correspond to an identity feature of the object or may be capable of being derived from it. In the course of the process, further data are captured as object data and, expediently, are also stored, in particular the optical object data and at least one current position of the object, in the form of positional data.

Sorting data, from which a sorting destination of a particular object can be derived or which directly describe the sorting destination, can be captured, for example optically, for example by means of a barcode on the object, or may already be stored in the control unit and assigned to the identity data, so that the sorting data can be located on the basis of the identification data. The sorting data can likewise be stored as part of the object data of a respective object.

The sorting device can be any device, facility or system suitable for sorting objects, having at least one entry point and several transfer points for discharging selected objects. For example, it can be a continuous conveyor, e.g. ring sorter, with conveyor units that are equipped with tipping trays, drop-down flaps or transverse conveyor belt elements. On the other hand, it also comprises discontinuous working techniques, such as a sorting system with driverless transport vehicles.

The transfer points can be discharge devices of a sorting or continuous conveyor, to which a delivery path is connected, e.g. in the form of a conveyor, a slide, a roller conveyor and/or a container into which the objects are dropped or thrown. The combination of a transfer point, e.g. a discharge device of a sorting conveyor, with a delivery path following on from it which extends to a removal point and which can be formed, for example, by a removal conveyor, is also referred to as the end point.

A discharge device can for example have a slide, pusher or flipper.

The optical object data of the objects can be captured by at least one camera and/or at least one scanner, in particular a laser scanner.

Tracking comprises determining the position, successively at chronological intervals which can be either fixed, e.g. time intervals of between 0.1 ms and 10 s, or result from other parameters and are not directly predetermined.

When one or more dimensions of the object are captured, optical capture processes can for example be carried out in one, two or all three coordinate directions, e.g. by means of at least one measuring camera, a laser measuring device or by means of light barrier arrangements. In addition or alternatively, one or more images of the object can be taken, and the weight of the object can be recorded, e.g. by means of a weighing device integrated in the area of an infeed belt. The captured data for dimensions, images and/or weight are preferably stored as part of the object data assigned to the object.

It can be envisaged that the object is actively conveyed along the delivery path or moves in an unpowered manner, e.g. slips, rolls or falls.

The repeated positional determinations that are carried out at short intervals within the framework of tracking are, expediently, carried out by means of optical capture of the object, in particular by one or more cameras or scanners, wherein image data or optical tracking data are generated, and by comparing these data with the optical object data that have been previously captured and stored. This comparison can be made with each determination of position, after a certain number of positional determinations, e.g. at every second, fifth, tenth or 100th, at predetermined time intervals, or at any rate at the latest when the object is removed, in order to produce—by this point in time at the latest—a link or assignment between the previously captured optical object data and/or other object data of the object and the object data captured in the context of tracking, in particular image data, so that by the time of removal at the latest, the object is clearly identified or at least its recipient data can be assigned.

Expediently, the same camera or scanner device is intended for both the acquisition of the optical object data and the repeated optical capture of the object in the context of tracking.

For preference, it is envisaged that a position and/or a time of removal of the discharged object from the removal path is captured and preferably also stored, in particular as a further part of the object data of the object.

The optical object data can be captured at a predetermined time, as an alternative to capture at a predetermined position, or when the object has been discharged from the sorting device at the transfer point.

It is within the scope of the invention that several discharged objects are simultaneously located on the delivery path, and each individual object is tracked. Irrespective of whether tracking is of a single object or of several objects simultaneously, in the context of the invention this means an essentially continuous visual capture and determination of the position of an object or of each individual object at short intervals (e.g. less than 1 ms, 10 ms or 100 ms), so that the position of one or each object on the delivery path is known at any time or, more precisely, at consecutive time points at short intervals. It is sufficient to store the respective last or current position of the object as part of the object data, wherein this can be overwritten by the next current position. The aforementioned time intervals can be so small that the capturing of the position is practically continuous.

Where numerous objects are transferred in rapid succession to one and the same transfer point, it can happen that when an object is tracked, the loss of the assignment of the object data to the physical position of the object may occur at a position along the delivery path, for example because the object is intermittently completely or partially obscured from the view of the image acquisition device or camera that it used for tracking by one or more other objects, or because an object is removed from the delivery path, for example if it falls down from the delivery path or is taken manually, and is then manually replaced on the delivery path, wherein in such a case it is envisaged that after assignment has been lost, tracking is continued as soon as possible, i.e. in particular as soon as the object is no longer obscured from the view of the image acquisition device or has been replaced, in particular in that further optical object data and, expediently, also the physical position of the object are captured and compared with the optical object data, and if the optical object data agree with the further optical object data within the scope of a defined tolerance range, the tracking is continued on the basis of the previously captured optical object data, wherein the tracking comprises repeated successive determinations of the object's position along the delivery path at chronological intervals until the removal of the object, and storage of a current position of the object as a further part of the object data of the object.

In the event of repeated loss of the assignment of the object data to a physical position of the object, the aforementioned steps can be run through again.

If the further optical object data deviate from the optical object data outside a given tolerance range, an error message can be added to the object data.

It can be envisaged that all the objects located within the delivery path between the transfer point and the point of removal are continuously captured and tracked by the tracking system and, in the event of an object being obscured by another object in the delivery path or removal of an object from the delivery path, the tracking of the object is continued as soon as possible, in particular as soon as the object is no longer obscured or has been replaced on the delivery path.

It lies within the scope of the invention that the object data of all objects that are simultaneously located on a delivery path of a transfer point and have not yet been removed are assigned to the transfer point as a subset of all the object data present in the sorting device, and when the further optical object data are compared with the optical object data, the optical object data of the subset of object data assigned to the transfer point are used.

Expediently, the invention envisages that the identity data or object data of an object taken from the delivery path, and/or any information derived from them, are communicated to a person or removal device removing the object. For example, the derived information may be the position of an object in the sequence of a delivery run of a driver of a parcel delivery vehicle, and knowledge of it may enable better loading of the vehicle. An exact storage position in the parcel delivery vehicle can also be communicated. The invention thus advantageously allows that the person or removal device taking an object does not need to determine the identity of the object again, but has the identity data that have already been captured directly available on the basis of the positional tracking of the object, and possibly also further information.

It can be envisaged that at the entry point, e.g. on an infeed device, or on the sorting device itself, the dimensions and/or the weight of an object are recorded and stored as part of the object data, and are communicated to a control unit as needed.

With regard to the device, the object of the invention is achieved by a device for producing and maintaining an assignment of object data of an object to a changing physical position of the object in a sorting device which comprises least one entry point for supplying objects to the sorting device and numerous transfer points at which selected objects can be discharged from the sorting device, and comprises

- a storage device for storing the object data, a position and optical object data,
- a discharge device for discharging a particular object from the sorting device at a specific transfer point,
- a capture device located in the area of the transfer point, for capturing optical object data and for tracking one or more objects discharged at the transfer point by means of a tracking system, and a control unit which is set up to control the sorting device to execute the method according to the invention.

Further advantages and features of the invention arise from the following description of an embodiment, wherein reference is made to a drawing in which

DETAILED DESCRIPTION

Figure 1:
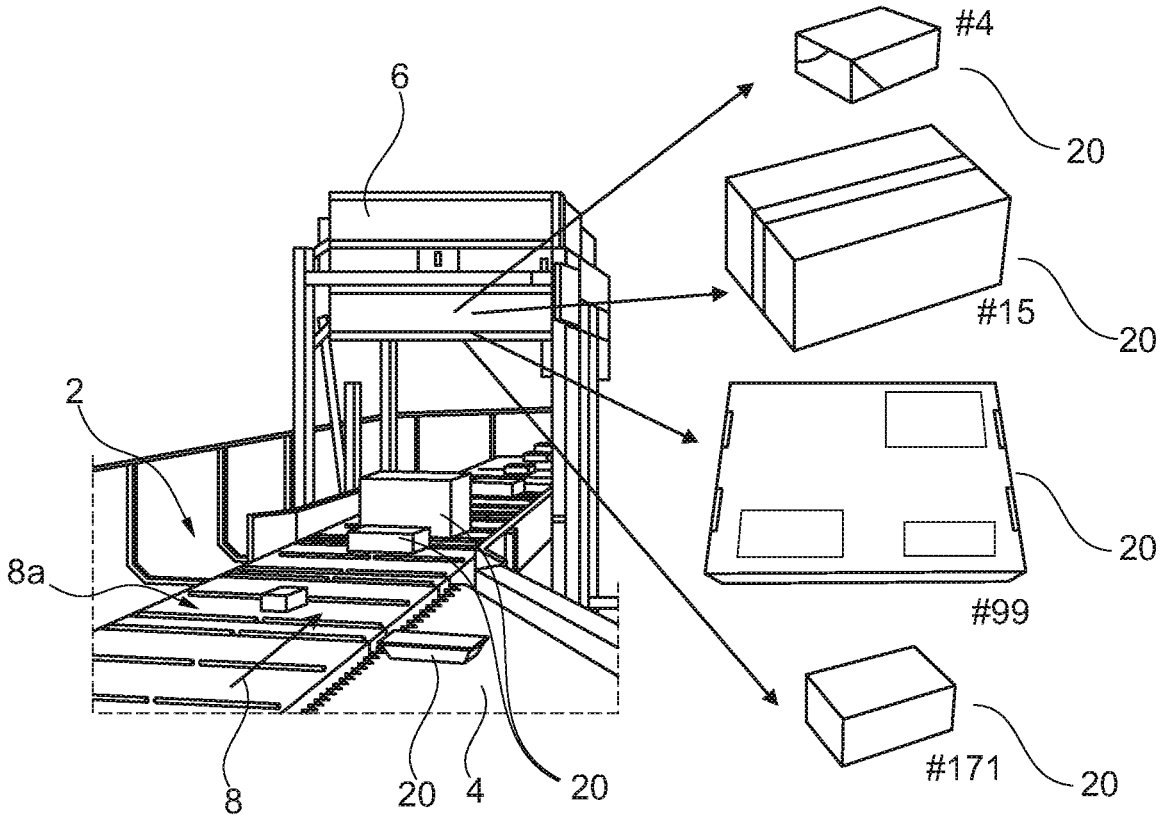
FIG. 1 shows a partial section of a sorting conveyor in the area of a transfer point with a device arranged above it for capturing image data and identity characteristics of objects.

FIG. 1 shows part of a sorting device in the form of a sorting conveyor 2, which comprises at least one entry point in the form of an infeed device 4, on which the objects 20 that are to be sorted can be fed individually to the sorting conveyor 2, with FIG. 1 showing only a foremost end section abutting the sorting conveyor 2, with an object 20 that is just about to be fed in. FIG. 1 also shows a capture device 6, e.g. in the form of a camera, a scanner or a combination thereof, with which initial image data and identity features of each individual object 20 can be captured on the sorting conveyor 2 as object data. Preferably, the capture device 6 is also set up to capture the dimensions of the objects as well as to establish the weight.

In the example shown, the sorting conveyor 2 comprises a number of transport units 8*a* that are moved in a direction of travel 8, each of which is provided with a transverse conveyor belt element that can be driven cross-wise to the direction of travel 8, on which in each case one object can be received, transported and delivered to a specific transfer point or a specific end point. Here, the transfer point 10 is formed by an essentially familiar discharge device.

Figure 2:
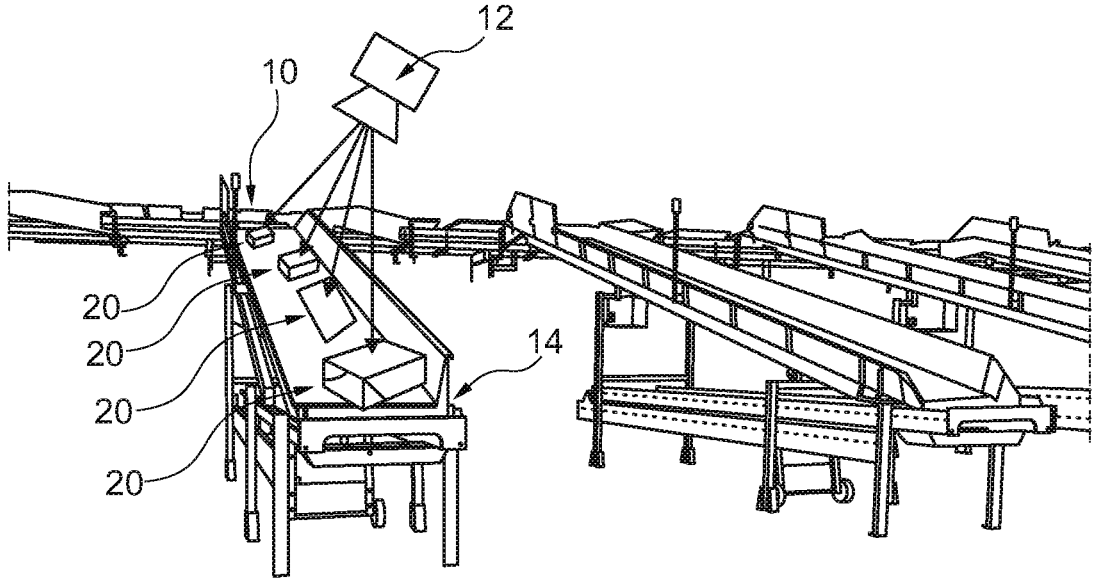
FIG. 2 shows a delivery path branching off from the sorting conveyor, with discharged objects located on it, and a camera arranged in the area of the transfer point.
Figure 3:
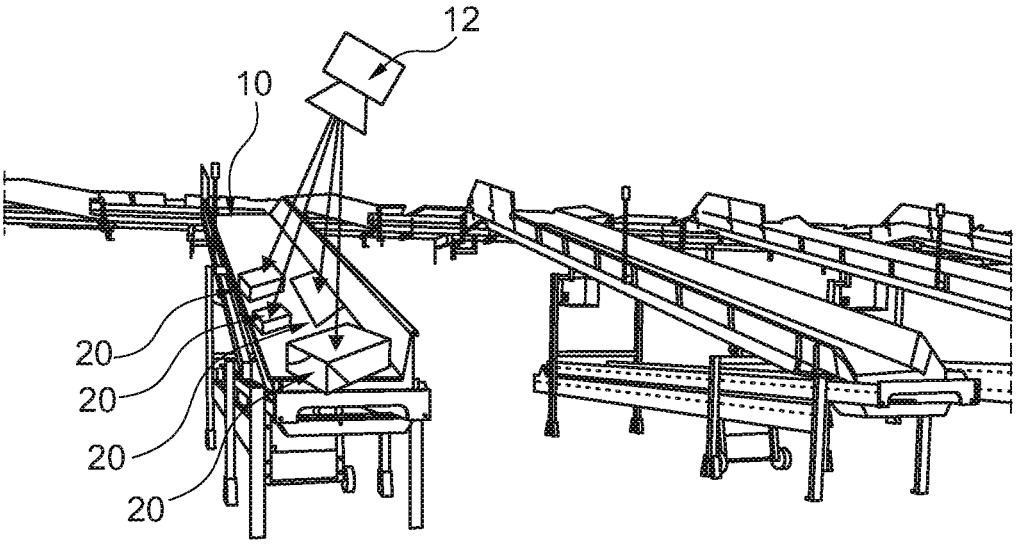
FIG. 3 shows the end point according to FIG. 2, wherein the objects are shown in a different position at a later point in time.

FIG. 2 shows such a transfer point 10 with a delivery path following on from it which connects to the side of the sorting conveyor 2, crosswise to the direction of travel 8 or at a certain angle.

A central control unit of the sorting system, to which the object data or the initial image data and identity features of each individual object that has been fed in are communicated, at the same time has sorting data for each individual object, from which it is possible to derive to which transfer point or into which end point each individual object located on the sorting conveyor 2 is to be discharged.

Furthermore, on the basis of the known position of the infeed device and the likewise known speed of the sorting conveyor, the control unit continuously receives logical and/or physical positional data for each individual object located on the sorting conveyor, or it can determine them on the basis of the speed of the sorting conveyor, i.e. logical positional data in relation to an assignment of an object to the transportation unit of the sorting conveyor that bears it, and/or physical positional data.

Since the control unit knows the sorting destination of each object on the basis of the aforementioned sorting data, and thus knows the transfer point at which the object is to be discharged, at or shortly before reaching the specific transfer point the control unit can communicate a discharge signal to the sorting conveyor or the transportation unit bearing a specific object, whereupon the transverse conveyor belt element is set into operation and the object is discharged to the specific transfer point 10.

It goes without saying that numerous infeed devices can be provided for feeding objects to the sorting conveyor, and a capture device can be provided at one or more infeed devices, either downstream of the infeed device on the sorting conveyor, as shown in FIG. 1, or directly on the infeed device, for the acquisition of certain object data for the objects when or immediately before they are fed in, e.g. identity data, image data, general optical object data and/or dimensions or weight.

As FIG. 2 shows, arranged in the area of the transfer point 10, in this case approximately centrally above the delivery path that follows on from it, is an image acquisition device in the form of a camera 12, with which optical object data such as e.g. image data are captured for each object that is to be or has been discharged at the transfer point 10, if these have not already been captured before. The camera or image acquisition device is connected to the control unit and communicates the optical object data to it, or these data can be retrieved from the image acquisition device by the control unit.

Before, during or after the discharging of an object at the transfer point assigned to it, in this example, the discharge device, the control unit registers the discharged object as an object located at or following on from the specific transfer point, wherein the object data of such objects assigned to a particular transfer point can be stored as a subset of all the object data present in the sorting device. In the example of FIG. 2, four objects have been discharged at the transfer point 10, so that the subset of object data comprises the object data such as image data or optical object data and identity data of these four objects in combination with or assignment to the transfer point 10.

Each discharged object is tracked from the transfer point 10 with respect to its position along the delivery path up to of its eventual removal at a removal point 14. This tracking is carried out in an essentially familiar manner, by means of the camera 12 taking a picture of the object at short intervals which may be less than 1 ms or less than 10 ms, and comparing it with an image that has been taken shortly before in each case, from which a current position of the object is determined. Each current position of an object is stored as part of the object data of the object, so that at all times, there is an assignment of the object data of the object and of the position.

The object is tracked by the aforementioned tracking system until it is removed from the delivery path, in particular up to a removal point 14, which can be set up in such a way that each object discharged at the transfer point 10 is regularly removed there. Alternatively, it is possible for an object to be removed from the delivery path at any point along it.

In the tracking of an object, the assignment of the object data to the physical position of the object may be lost as it moves along the delivery path, for example, if the object is briefly obscured by other objects and is not visible or is not fully visible to the camera. For this eventuality, it is envisaged that after the loss of the assignment, further optical object data, in particular image data, of the object are captured, in particular as soon as it is no longer obscured by other objects and becomes visible to the camera again, and that these further optical object data or image data are compared with the original, previously captured optical object data or image data. If agreement is found between the further image data or optical object data and the corresponding previously captured image data or optical object data that lies within a predetermined tolerance range, the tracking of the object can be continued. Here, either the further optical object data can be taken as the basis and stored, e.g. as a further part of the object data, or the tracking can be continued on the basis of the previously captured optical object data.

Since the object data of each object at the end point 10 are stored in the control unit, this information can be used when an object is removed from the end point or the delivery path or removal point, in order for example to transport onwards or store several objects belonging to one sorting destination together, or to remove objects belonging to different sorting points from one and the same delivery path or sampling point, and on the basis of the sorting information that is known for each object, to assign different sorting destinations and to arrange different onward transportation.

This makes it possible to assign several sorting targets to one and the same transfer point and thus save on transfer points or use them several times.

Figure 4:
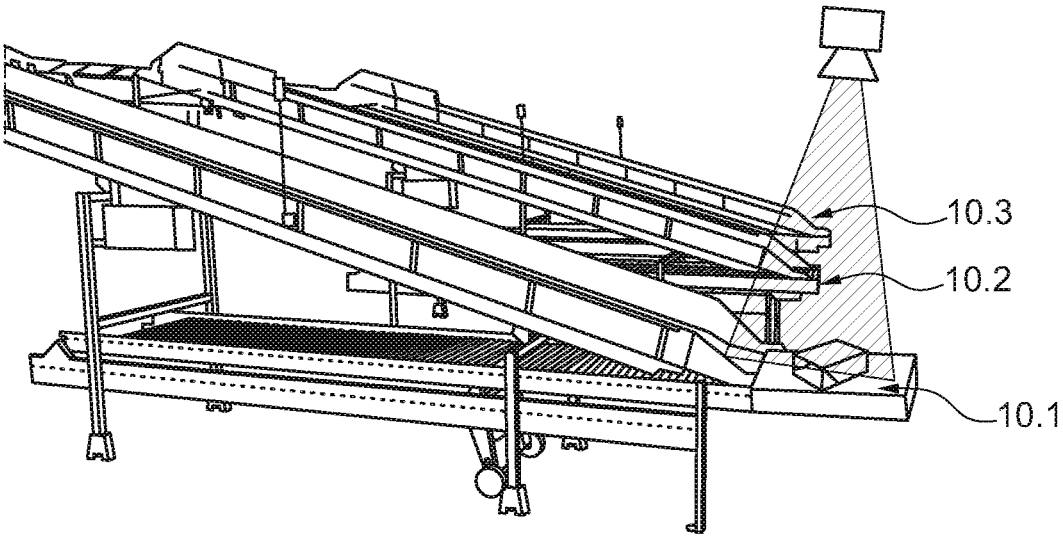
FIG. 4 shows a side view of the delivery path according to FIGS. 2 and 3.

FIG. 4 explains, in a side view, the arrangement of several transfer points or end points 10.1, 10.2, 10.3, etc., wherein in the example shown, the end point 10 and 10.1 is referred to as "destination #32", as is also indicated in FIG. 1, where the four objects (#4, #15, #99, #171) are assigned to the sorting destination "destination #32".

We claim:

1. A method for producing and maintaining an assignment of object data of an object to a changing physical position of the object, comprising the steps of:

in a sorting device which comprises at least one entry point for feeding objects to the sorting device and a plurality of transfer points at which selected objects can be discharged from the sorting device onto a delivery path, each delivery path extending from a transfer point to a removal point, where the delivery path is arranged for removal of an object from the delivery path at the removal point or at any point along the delivery path, feeding in a plurality of objects, of which at least one identity feature can be stored as part of object data for each object, at an entry point of the sorting device, capturing of identity data of each individual object before, during or after such feeding in, and storage of the identity data as part of object data of the object;

on the basis of sorting data from which a sorting target for the object can be derived for each individual object, determining a transfer point that is assigned to each object;

transporting each object as far as its specified transfer point;

discharging the objects at their specified transfer point;

capturing optical object data of each individual object discharged at the transfer point once the object has reached (i) a predetermined position on the sorting device, (ii) at the transfer point or (iii) along the delivery path, and storing the optical object data as a further part of the object data;

transporting the objects along the delivery path towards the removal point; and during that transportation, (i) following each individual discharged object on the basis of the optical object data by means of tracking, wherein the tracking comprises repeated determination of the position of each individual object along the delivery path at successive chronological intervals, each determination of the position comprising generating optical tracking data and comparing these data with optical object data that have been previously captured and stored, until the object is removed from the delivery path, and (ii) storing a current position of the object as a further part of the object data of the object.

2. The method according to claim 1, wherein the tracking for each determination of the position comprises optical capture of the object, wherein a comparison with the optical object data takes place at each positional determination, at certain time intervals or when the object is removed.

3. The method according to claim 1, further comprising during, before or after the feeding in of an object, one or more dimensions and/or one or more images and/or a weight of an object are collected and stored as part of the object data.

4. The method according to claim 1, wherein the object is actively conveyed along the delivery path or moves in an unpowered manner, slips, rolls or falls.

5. The method according to claim 1, wherein a removal position and/or time of removal of the object from the delivery path is captured and stored.

6. The method according to claim 1, wherein the capture of the optical object data is carried out at a predetermined point in time or when the object has been discharged from the sorting device at the transfer point.

7. The method according to claim 1, wherein several discharged objects are simultaneously located on the delivery path and each individual object is tracked by the tracking system.

8. The method according to claim 1, wherein during the tracking of the object, a loss of the assignment of the object data to the physical position of the object occurs at a position along the delivery path, wherein, after the loss of the assignment, further optical object data of the object are captured as soon as possible and are compared with the optical object data, and wherein if the optical object data match the further optical object data within the scope of a specified tolerance range, the tracking of the object is continued on the basis of the optical object data.

9. The method according to claim 8, wherein in the event of a repeated loss of the assignment of the object data to the physical position of the object, the steps according to claim 8 are run through again.

10. A method for producing and maintaining an assignment of object data of an object to a changing physical position of the object, comprising the steps of:

in a sorting device which comprises at least one entry point for feeding objects to the sorting device and a plurality of transfer points at which selected objects can be discharged from the sorting device onto a delivery path, each delivery path extending from a transfer point to a removal point, where the delivery path is arranged for removal of an object from the delivery path at the removal point or at any point along the delivery path, feeding in an object, of which at least one identity feature can be stored as part of object data of the object, at an entry point of the sorting device, capturing of identity data before, during or after such feeding in, and storage of the identity data as part of object data of the object;

on the basis of sorting data from which a sorting target for the object can be derived for each object, determining a transfer point that is assigned to the object;

transporting the object as far as the specified transfer point;

discharging the object at the specified transfer point;

capturing optical object data of each object discharged at the transfer point once the object has reached (i) a predetermined position on the sorting device, (ii) at the transfer point or (iii) along the delivery path, and storing the optical object data as a further part of the object data;

transporting the object along the delivery path towards the removal point; and during that transportation, (i) following the discharged object on the basis of the optical object data by means of tracking, wherein the tracking comprises repeated determination of the position of the object along the delivery path at successive chronological intervals, each determination of the position comprising generating optical tracking data and comparing these data with optical object data that have been previously captured and stored, until the object is removed from the delivery path, and (ii) storing a current position of the object as a further part of the object data of the object;

wherein during the tracking of the object, a loss of the assignment of the object data to the physical position of the object occurs at a position along the delivery path, wherein, after the loss of the assignment, further optical object data of the object are captured as soon as possible and are compared with the optical object data, and wherein if the optical object data match the further optical object data within the scope of a specified tolerance range, the tracking of the object is continued on the basis of the optical object data; and wherein in the event that the further optical object data deviate from the optical object data outside the tolerance range, an error message is added to the object data.

11. The method according to claim 7, wherein all objects located within the delivery path between the transfer point and the removal point are continuously captured and tracked by the tracking system and, in the event of an object being obscured by another object in the delivery path, the tracking of the obscured object is continued as soon as the object is no longer obscured.

12. A method for producing and maintaining an assignment of object data of an object to a changing physical position of the object, comprising the steps of:

in a sorting device which comprises at least one entry point for feeding objects to the sorting device and a plurality of transfer points at which selected objects can be discharged from the sorting device onto a delivery path, each delivery path extending from a transfer point to a removal point, where the delivery path is arranged for removal of an object from the delivery path at the removal point or at any point along the delivery path, feeding in an object, of which at least one identity feature can be stored as part of object data of the object, at an entry point of the sorting device, capturing of identity data before, during or after such feeding in, and storage of the identity data as part of object data of the object;

on the basis of sorting data from which a sorting target for the object can be derived for each object, determining a transfer point that is assigned to the object;

transporting the object as far as the specified transfer point;

discharging the object at the specified transfer point;

capturing optical object data of each object discharged at the transfer point once the object has reached (i) a predetermined position on the sorting device, (ii) at the transfer point or (iii) along the delivery path, and storing the optical object data as a further part of the object data;

transporting the object along the delivery path towards the removal point; and during that transportation, (i) following the discharged object on the basis of the optical object data by means of tracking, wherein the tracking comprises repeated determination of the position of the object along the delivery path at successive chronological intervals, each determination of the position comprising generating optical tracking data and comparing these data with optical object data that have been previously captured and stored, until the object is removed from the delivery path, and (ii) storing a current position of the object as a further part of the object data of the object;

wherein during the tracking of the object, a loss of the assignment of the object data to the physical position of the object occurs at a position along the delivery path, wherein, after the loss of the assignment, further optical object data of the object are captured as soon as possible and are compared with the optical object data, and wherein if the optical object data match the further optical object data within the scope of a specified tolerance range, the tracking of the object is continued on the basis of the optical object data; and wherein the object data of all objects that are simultaneously located on a delivery path of a transfer point and have not yet been removed are assigned to the transfer point as a subset of all the object data present in the sorting device, and when the further optical object data are compared with the optical object data, the optical object data of the subset of object data assigned to the transfer point are used.

13. The method according to claim 1, wherein the identity data or object data of an object taken from the delivery path, and/or any information derived from them, are communicated to a person or removal device removing the object.

14. A device for producing and maintaining an assignment of object data of an object to a changing physical position of the object in a sorting device, comprising:

at least one entry point for supplying objects to the sorting device and a plurality of transfer points at which selected objects can be discharged from the sorting device;

a storage device for storing the object data of a position and of optical object data;

a discharge device for discharging a particular object from the sorting device at a specific transfer point onto a delivery path, each delivery path extending from the transfer point to a removal point, where the delivery path is arranged for removal of an object from the delivery path at the removal point or at any point along the delivery path;

a capture device located in the area of the transfer point, for capturing optical object data and for tracking one or more objects discharged at the transfer point;

a control unit which is configured to control the sorting device for executing the steps comprising:

feeding in a plurality of objects, of which at least one identity feature can be stored as part of object data for each object, at an entry point of the sorting device, capturing of identity data of each individual object before, during or after such feeding in, and storage of the identity data as part of object data of the object, on the basis of sorting data from which a sorting target for the object can be derived for each individual object, determining a transfer point that is assigned to each object, transporting each object as far as its specified transfer point, and discharging the object at their specified transfer point onto the delivery path, capturing optical object data of each individual object discharged at the transfer point once the object has reached (i) a predetermined position on the sorting device, (ii) at the transfer point or (iii) along the delivery path extending from the transfer point to a removal point, and storing the optical object data as a further part of the object data, transporting the objects along the delivery path towards the removal point, and during that transportation, (i) following each individual discharged object on the basis of the optical object data by means of tracking, wherein the tracking comprises repeated determination of the position of each individual object along the delivery path at successive chronological intervals, each determination of the position comprising generating optical tracking data and comparing these data with optical object data that have been previously captured and stored, until the object is removed, from the delivery path, and (ii) storing a current position of the object as a further part of the object data of the object.

15. A device according to claim 14, wherein the sorting device comprises tilting bowl units, drop flap units, transverse conveyor belt units, and/or driverless transport vehicles.

16. A method for producing and maintaining an assignment of object data of an object to a changing physical position of the object in a sorting device which comprises at least one entry point for feeding objects to the sorting device and a plurality of transfer points at which selected objects can be discharged from the sorting device, with the steps comprising:

feeding in a plurality of objects, of which at least one identity feature can be stored as part of object data for each object, at an entry point of the sorting device, capturing of identity data of each individual object before, during or after such feeding in, and storage of the identity data as part of object data of the object;

on the basis of sorting data from which a sorting target for the object can be derived for each individual object, determining a transfer point that is assigned to each object;

transporting each object as far as its specified transfer point;

discharging the objects at their specified transfer point;

capturing optical object data of each individual object discharged at the transfer point once the object has reached (i) a predetermined position on the sorting device, (ii) at the transfer point or (iii) along a delivery path extending from the transfer point to a removal point, and storing the optical object data as a further part of the object data;

transporting the objects along the delivery path where the delivery path is arranged for removal of an object from the delivery path at the removal point or at any point along the delivery path;

during the transportation, (i) following each individual discharged object on the basis of the optical object data by means of tracking, wherein the tracking comprises repeated determination of the position of each individual object along the delivery path at successive chronological intervals, each determination of the position comprising generating optical tracking data and comparing these data with optical object data that have been previously captured and stored, until the object is removed from the delivery path, and (ii) storing a current position of the object as a further part of the object data of the object;

wherein during the tracking of the object, a loss of the assignment of the object data to the physical position of the object occurs at a position along the delivery path, wherein, after the loss of the assignment, further optical object data of the object are captured as soon as possible and are compared with the optical object data, and wherein if the optical object data match the further optical object data within the scope of a specified tolerance range, the tracking of the object is continued on the basis of the optical object data; and wherein in the event that the further optical object data deviate from the optical object data outside the tolerance range, an error message is added to the object data.

17. A method for producing and maintaining an assignment of object data of an object to a changing physical position of the object in a sorting device which comprises at least one entry point for feeding objects to the sorting device and a plurality of transfer points at which selected objects can be discharged from the sorting device, with the steps comprising:

feeding in an object, of which at least one identity feature can be stored as part of object data of the object, at an entry point of the sorting device, capturing of identity data before, during or after such feeding in, and storage of the identity data as part of object data of the object;

on the basis of sorting data from which a sorting target for the object can be derived for each object, determining a transfer point that is assigned to the object;

transporting the object as far as the specified transfer point;

discharging the object at the specified transfer point;

capturing optical object data of each object discharged at the transfer point once the object has reached (i) a predetermined position on the sorting device, (ii) at the transfer point or (iii) along a delivery path extending from the transfer point to a removal point, and storing the optical object data as a further part of the object data;

transporting the object along the delivery path;

during the transportation, (i) following the discharged object on the basis of the optical object data by means of tracking, wherein the tracking comprises repeated determination of the position of the object along the delivery path at successive chronological intervals, each determination of the position comprising generating optical tracking data and comparing these data with optical object data that have been previously captured and stored, until the object is removed from the delivery path, and (ii) storing a current position of the object as a further part of the object data of the object;

wherein during the tracking of the object, a loss of the assignment of the object data to the physical position of the object occurs at a position along the delivery path, wherein, after the loss of the assignment, further optical object data of the object are captured as soon as possible and are compared with the optical object data, and wherein if the optical object data match the further optical object data within the scope of a specified tolerance range, the tracking of the object is continued on the basis of the optical object data; and wherein the object data of all objects that are simultaneously located on a delivery path of a transfer point and have not yet been removed are assigned to the transfer point as a subset of all the object data present in the sorting device, and when the further optical object data are compared with the optical object data, the optical object data of the subset of object data assigned to the transfer point are used.

* * * * *